US005323469A

United States Patent [19]

Scholz

[11] Patent Number: 5,323,469

[45] Date of Patent: Jun. 21, 1994

[54] CONICAL LOUDSPEAKER HAVING A CONICAL STABILIZING ELEMENT JOINED BETWEEN AN UNDERSIDE OF A SPEAKER MEMBRANE AND AN OUTSIDE SURFACE OF A SPEAKER MOVING COIL CARRIER

[75] Inventor: Leander Scholz, Straubing, Fed. Rep. of Germany

[73] Assignee: Nokia (Deutschland) GmbH, Pforzheim, Fed. Rep. of Germany

[21] Appl. No.: 922,202

[22] Filed: Jul. 30, 1992

[30] Foreign Application Priority Data

Jul. 31, 1991 [DE] Fed. Rep. of Germany ..... 9109452

[51] Int. Cl.[5] ..... H04R 25/00

[52] U.S. Cl. ..... 381/204; 381/202; 381/197

[58] Field of Search ..... 381/204, 202, 203, 192, 381/197, 182, 184, 186, 194; 181/161, 171, 172, 163, 144

[56] References Cited

U.S. PATENT DOCUMENTS

| | | | |
|---|---|---|---|
| 1,897,294 | 2/1933 | Bernard | 381/204 |
| 2,071,828 | 2/1937 | Glen | 381/186 |
| 2,641,329 | 6/1953 | Levy et al. | 381/204 |
| 5,143,169 | 9/1992 | Ziegenberg et al. | 181/144 |

FOREIGN PATENT DOCUMENTS

| | | | |
|---|---|---|---|
| 3929266 | 1/1991 | Fed. Rep. of Germany . | |
| 9109452 | 10/1991 | Fed. Rep. of Germany . | |
| 0687655 | 8/1930 | France | 381/204 |
| 1079073 | 11/1954 | France | 381/182 |
| 0253687 | 6/1926 | United Kingdom | 381/204 |
| 378986 | 5/1931 | United Kingdom . | |
| 0378986 | 8/1932 | United Kingdom | 381/203 |
| 440041 | 6/1934 | United Kingdom . | |

*Primary Examiner*—Curtis Kuntz
*Assistant Examiner*—Huyen D. Le

[57] ABSTRACT

In order to stabilize conical loudspeakers, it is recommended according to the present invention that the underside (20) of the membrane (12) be joined by means of a stabilizing element (19) joined to the moving coil carrier (14). This triangular structure alone results in sufficient stabilization of the membrane. If, in addition, the underside (20) of the membrane (12) is supported by the stabilizing element (19) at a point at which the first radial oscillation mode occurs, premature decoupling of the outer regions of the membrane is prevented.

12 Claims, 3 Drawing Sheets

Figure 1:
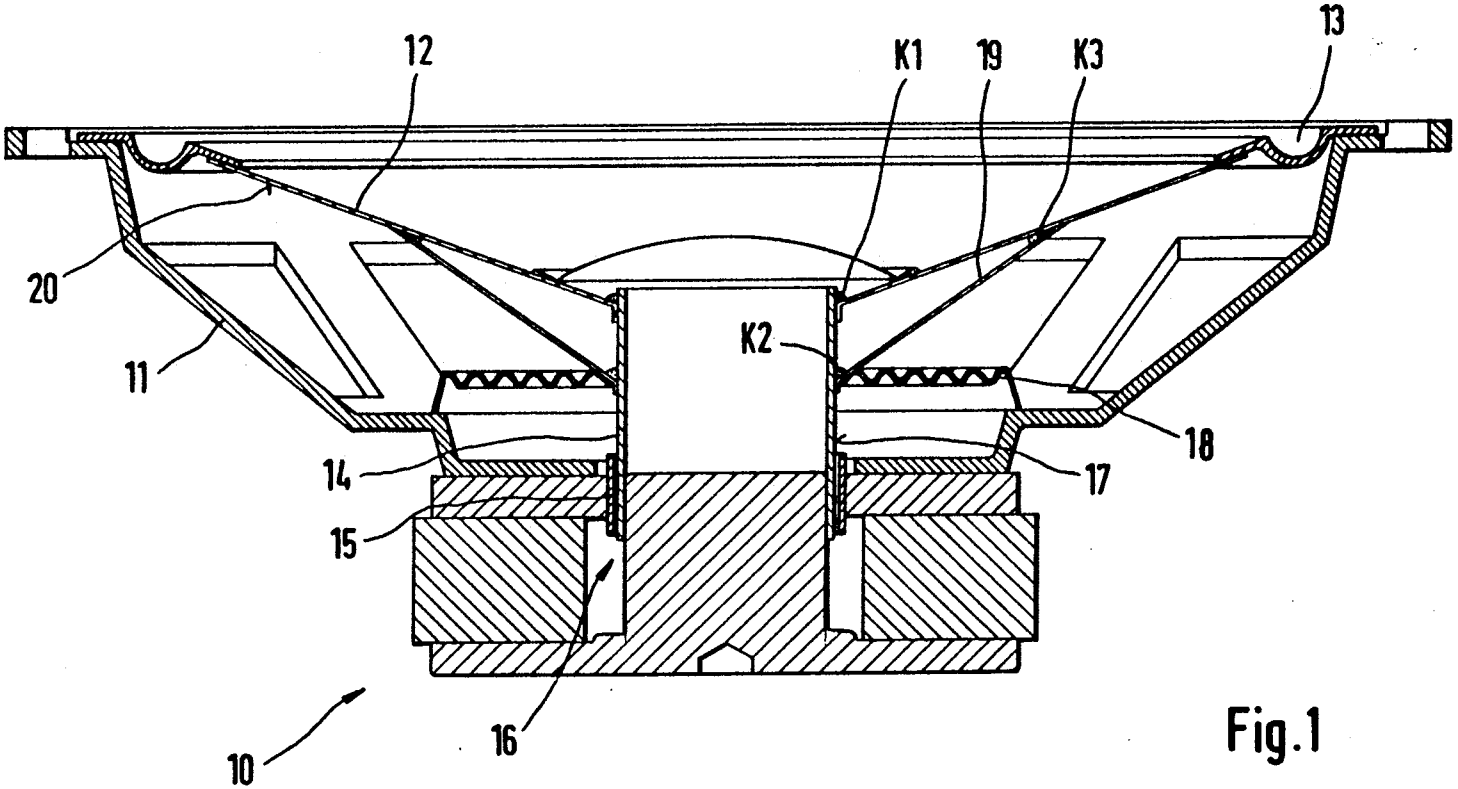

CONICAL LOUDSPEAKER HAVING A CONICAL STABILIZING ELEMENT JOINED BETWEEN AN UNDERSIDE OF A SPEAKER MEMBRANE AND AN OUTSIDE SURFACE OF A SPEAKER MOVING COIL CARRIER

TECHNICAL FIELD

The invention concerns the improvement of conical loudspeakers, especially the improvement of membrane stability.

STATE OF THE ART

Because of its enormously wide distribution and consequent general familiarity, the conical loudspeaker indicated in the preamble of claim 1 requires no explanation beyond the statement given in the preamble. The membrane of a conical loudspeaker of this type must meet two important criteria: It must be light, so that it can follow even steep signal pulses without delay; and it must have sufficient rigidity to follow the signal uniformly over its entire surface. The last criterion cannot always be met, especially in the case of loudspeakers with a large membrane diameter. In these loudspeakers, the electrical signals are not converted into a uniform excursion of the entire membrane surface, but rather the membrane experiences deformations at its surface due to partial oscillations. These deformations lead to acoustic pressure waves that do not correspond to the activating electrical signal. In other words, the input signal is reproduced incorrectly. The aforesaid disadvantage can be eliminated to a certain extent by manufacturing the membrane from an extraordinarily rigid material- There are limits to this possibility for improving membrane rigidity, however, since above a certain rigidity, materials and wall thicknesses are required that are no longer acceptable in terms of light membrane weight.

The object on which the invention is based is therefore the creation a conical loudspeaker that not only is characterized by a lightweight membrane design, but also possesses extraordinarily high rigidity and freedom from partial oscillation in the membrane.

EMBODIMENTS OF THE INVENTION

This object is achieved by the arrangement, between the underside of the membrane and the magnet, of a conical stabilizing element, the end of which with the greater diameter is joined to the underside of the membrane, and the other end of which is joined to the outside surface of the moving coil carrier. Advantageous embodiments and developments of the invention are indicated in claims 2 to 6. It is especially advantageous if the diameter of the end of the stabilizing element that is joined to the underside of the membrane is dimensioned so that this end of the stabilizing element supports the membrane circularly at a point at which the first radial oscillation mode occurs. Specifically, this prevents premature decoupling of the outer regions of the membrane, and simultaneously damps bell modes. The term "outer regions of the membrane" is understood to mean regions of the membrane that are closely adjacent to the loudspeaker bead. The term "decoupling" is understood to mean the occurrence of partial oscillations that change over to opposite-phase oscillation on a frequency-dependent basis, and decrease the effective (i.e. rigid) radiating surface of the loudspeaker. This decrease is counteracted by the arrangement of the stabilizing element, which together with a part of the moving coil carrier and a part of the membrane constitutes a rigid triangular structure.

If the stabilizing element and the centering membrane are adhesively bonded at the same point on the moving coil carrier, separate adhesive bonding of the stabilizing element to the moving coil carrier can even be eliminated.

BRIEF PRESENTATION OF THE FIGURES

Figure 2:
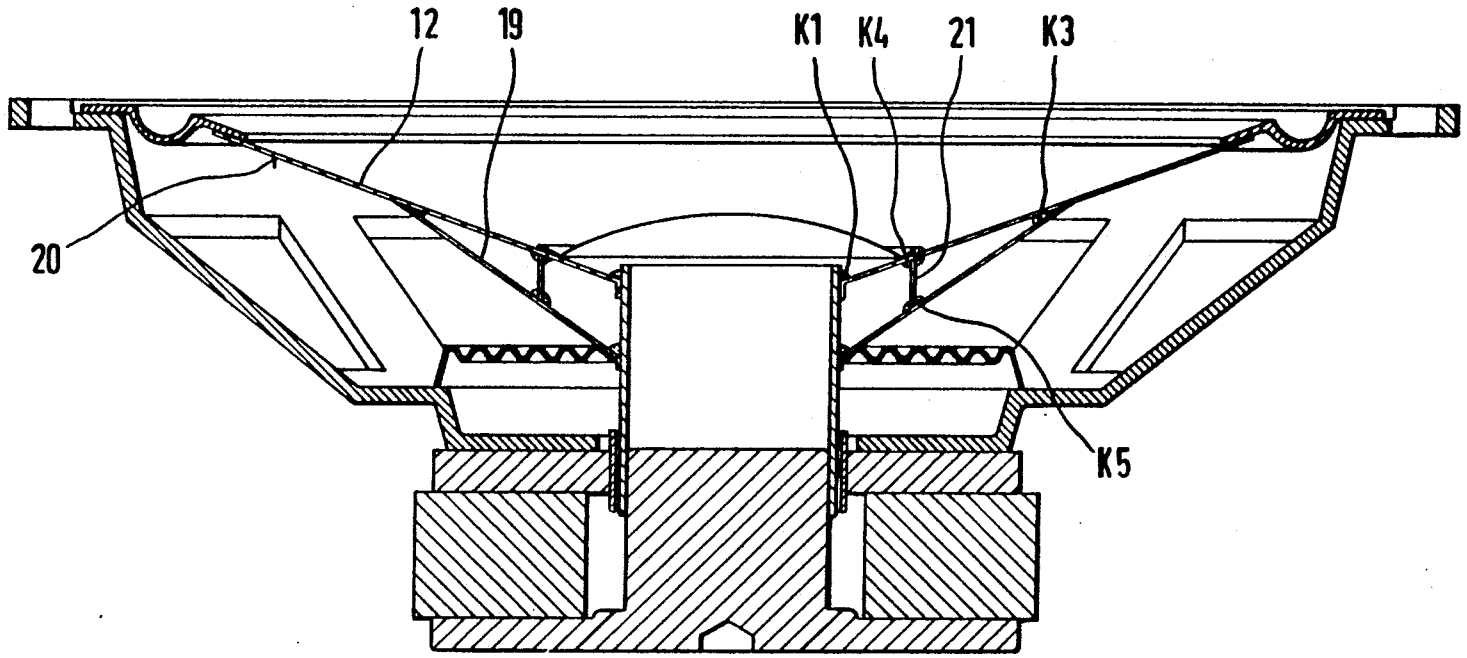

The Figures show:

In FIG. 1, a conical loudspeaker in section;

In FIG. 2, a further conical loudspeaker in section.

Figure 3:
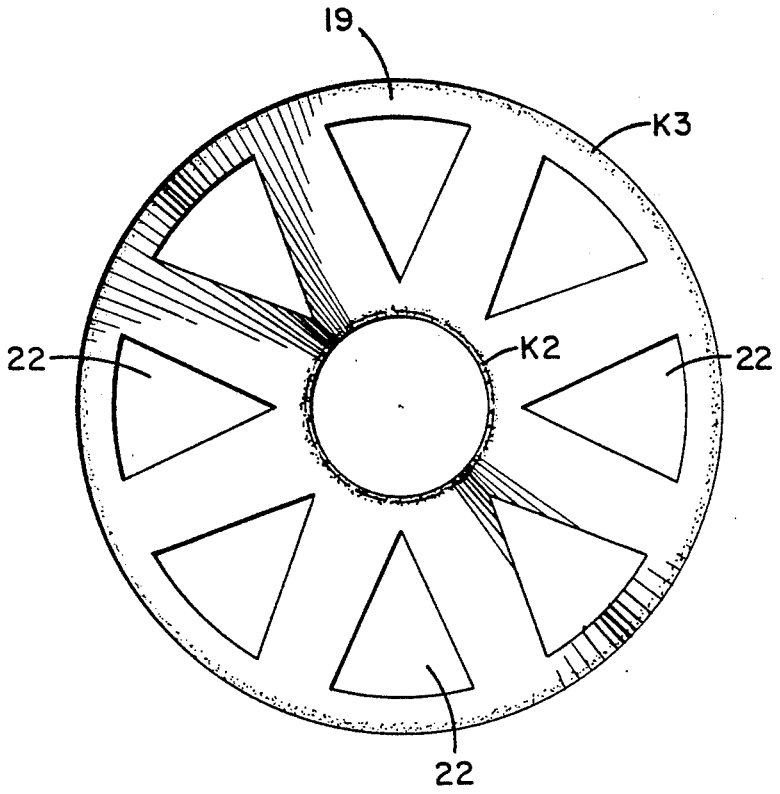

FIG. 3 shows a plan view of the stablizer 19 shown in FIGS. 1 and 2.

DESCRIPTION OF POSSIBLE EMBODIMENTS

The conical loudspeaker shown in FIG. 1 consists essentially of the magnet system 10 and the conical loudspeaker frame 11 joined thereto. Inserted in the loudspeaker frame 11 is the membrane 12, also conical in shape. The membrane 12 is joined to the upper edge of the loudspeaker frame 11 by means of a peripheral bead 13. The other end of the membrane 12 is joined, by means of the adhesive seam K1, to the tubular moving coil carrier 14. The other end of the moving coil carrier 14, around which the moving coil 15 is wound, projects into the air gap 16 of the magnet 10. In addition, the moving coil carrier 14 is joined at its outside surface 17, by means of an accordion-like centering membrane 18, to the loudspeaker frame 11. The connection between the moving coil carrier 14 and the centering membrane 18 is made by the adhesive seam K2 at an intermediate point I on the surface of the moving coil 15, as shown in FIGS. 1 and 2. This adhesive seam K2 also joins one end of the stabilizing element 19 to the moving coil carrier 14. The other end of the stabilizing element 19 is adhesively bonded to the underside 20 of the membrane 12 by means of the further adhesive seam K3. The geometry of the stabilizing element 19 is dimensioned so that the end that is joined to the membrane 12 has a diameter such that this end supports the membrane at a point at which the first radial oscillation mode occurs. Maintaining the aforesaid upper diameter of the stabilizing element 19 means that the radiating surface region of the membrane 12 is enlarged, since partial oscillations are greatly reduced when the membrane 12 is supported at this point.

The stabilizer element 19 has openings 22 in FIG. 3.

The loudspeaker shown in FIG. 2 differs from the one shown in FIG. 1 only in that the stabilizing element 19 in FIG. 2 has a different shape. This difference in shape consists in the fact that the membrane 12 is joined at its underside 20, in the region between the adhesive seams K1 and K3, by means of reinforcing element 21, to the stabilizing element 19 via adhesive seams K4 and K5.

In a further practical example (not illustrated), the stabilizing element 19 and the reinforcing element 21 can also be configured as a single piece, for example as a drawn foil part. In this case only one adhesive seam is required, joining the reinforcing element 21 to the underside 20 of the membrane 12.

I claim:

1. Conical loudspeaker, including a magnet system (10) having a tubular moving coil carrier 914) with a lower end that is provided with a moving coil (15), which projects into an air gap (16) of the magnet (10), and with an upper end that is connected to an end of a conical membrane (12), which has the smaller of the two diameters, characterized in that a substantially conical stabilizing element (19) is arranged between an underside (20) of the conical membrane (12) and the magnet (10), having its upper end with a greater diameter joined to an underside (20) of the membrane (12), and having its lower end joined to point intermediate said upper and lower end of an outside surface (17) of the moving coil carrier (14).

2. Conical loudspeaker according to claim 1, characterized in that the diameter of the upper end of the stabilizing element (19) is dimensioned so that the upper end is joined and supports the underside (20) of the membrane (12) circularly at a point where a first radial oscillation mode occurs.

3. Conical loudspeaker according to claim 2, characterized in that the stabilizing element (19) has openings in its outside surface.

4. Conical loudspeaker according to claim 2, characterized in that at least one additional reinforcing element (21) is arranged between the stabilizing element (19) and the membrane (12).

5. Conical loudspeaker according to claim 2, characterized in that the lower end of the stabilizing element (19) is joined at a position that a centering membrane (18) is joined to the moving coil carrier (14).

6. Conical loudspeaker according to claim 5, characterized in that the stabilizing element (19) has openings in its outside surface.

7. Conical loudspeaker according to claim 5, characterized in that at least one additional reinforcing element (21) is arranged between the stabilizing element (19) and the membrane (12).

8. Conical loudspeaker according to claim 6, characterized in that at least one additional reinforcing element (21) is arranged between the stabilizing element (19) and the membrane (12).

9. Conical loudspeaker according to claim 8, characterized in that the additional reinforcing element (21) has a conical cross section, and that the stabilizing element (19) and the additional reinforcing element (21) are configured as a one-piece component.

10. Conical loudspeaker according to claim 1, characterized in that the lower end of the stabilizing element (19) is joined at a position that a centering membrane (18) is joined to the moving coil carrier (14).

11. Conical loudspeaker according to claim 1, characterized in that the stabilizing element (19) has openings in its outside surface.

12. Conical loudspeaker according to claim 1, characterized in that at least one additional reinforcing element (21) is arranged between the stabilizing element (19) and the membrane (12).

* * * * *

UNITED STATES PATENT AND TRADEMARK OFFICE

CERTIFICATE OF CORRECTION

PATENT NO. : 5,323,469
DATED : June 21, 1994
INVENTOR(S) : L. Scholz

It is certified that error appears in the above-indentified patent and that said Letters Patent is hereby corrected as shown below:

At column 3, line 9, please insert --a-- prior to "point".

Signed and Sealed this

Eighth Day of November, 1994

*Attest:*

Bruce Lehman

BRUCE LEHMAN

*Attesting Officer*

*Commissioner of Patents and Trademarks*